US007871559B2

(12) United States Patent
Tsuchie et al.

(10) Patent No.: US 7,871,559 B2
(45) Date of Patent: Jan. 18, 2011

(54) INSPECTION HOLE STRUCTURE FOR FLASH-SMELTING FURNACE

(75) Inventors: Yasuhiro Tsuchie, Tamano (JP); Masakazu Ohno, Tamano (JP); Kenji Miyamoto, Tamano (JP); Masahiro Wakayama, Tamano (JP)

(73) Assignee: Pan Pacific Copper Co., Ltd., Tokyo (JP)

( * ) Notice: Subject to any disclaimer, the term of this patent is extended or adjusted under 35 U.S.C. 154(b) by 0 days.

(21) Appl. No.: 12/237,019

(22) Filed: Sep. 24, 2008

(65) Prior Publication Data

US 2009/0085263 A1 Apr. 2, 2009

(30) Foreign Application Priority Data

Sep. 28, 2007 (JP) ..... 2007-256651

(51) Int. Cl.
*C21B 7/24* (2006.01)

(52) U.S. Cl. ..... 266/100; 266/99

(58) Field of Classification Search ..... 266/99, 266/100

See application file for complete search history.

(56) References Cited

U.S. PATENT DOCUMENTS 3,478,236 A * 11/1969 Tyrrell ..... 310/11
2009/0165684 A1* 7/2009 Arakane et al. ..... 110/180

FOREIGN PATENT DOCUMENTS

JP 3381241 B2 12/2002

* cited by examiner

*Primary Examiner*—Scott Kastler
(74) *Attorney, Agent, or Firm*—Panitch Schwarze Belisario & Nadel LLP

(57) ABSTRACT

An inspection hole structure 1 forming a furnace inspection hole 2 installed on the reaction shaft ceiling 104 of a flash smelting furnace, comprising a lower-stage water-cooling jacket 3A having an opening 3Aa at the center; an upper-stage water-cooling jacket 3B which is connected integrally to an upper part of said lower-stage water-cooling jacket 3A and forms said inspection hole 2 at the center in cooperation with said lower-stage water-cooling jacket 3A; and a bottom cover water-cooling jacket 4 provided in said lower-stage water-cooling jacket 3A to open or close said opening of said lower-stage water-cooling jacket 3A.

4 Claims, 4 Drawing Sheets

INSPECTION HOLE STRUCTURE FOR FLASH-SMELTING FURNACE

BACKGROUND OF THE INVENTION

1. Field of the Invention

The present invention relates to an inspection hole structure which is installed on the reaction shaft ceiling of a flash smelting furnace and forms a furnace interior inspection hole. More particularly, the invention relates to an inspection hole structure for a flash smelting furnace, which has a water-cooling jacket structure.

2. Description of the Related Art

The flash smelting furnace is one of the conventionally available non-ferrous metal smelting furnaces using sulfide concentrate as a raw material. As shown in FIG. 4, the flash smelting furnace 100 comprises a reaction shaft 101, a settler 102 and an up-take 103. A concentrate burner 105 is installed in the reaction shaft 101 on the ceiling 104 thereof.

The concentrate is blown into the furnace through a concentrate burner 105. The flash smelting furnace 100 utilizes the oxidation reaction heat of the concentrate. In the case where the oxidation reaction heat alone is insufficient in heat quantity, combustion may be assisted by heavy oil or the like from the concentrate burner 105.

An inspection hole 106 for inspection and cleaning of the leading end of the concentrate burner 105 is installed on the reaction shaft ceiling 104 of the flash smelting furnace 100.

However, slag 300 deposits onto and grows on the inspection hole frame 107 forming the inspection hole 106 from the leading end of the concentrate burner 105. As a result, when performing a furnace inspecting operation such as inspection and cleaning of the leading end of the concentrate burner 105 by the use of the inspection hole 106, the cover 108 of the inspection hole could not sometimes be closed. It was difficult to peel off slag 300 adhering to the inspection hole frame 107.

The present inventors carried out repeated research efforts and experiments to solve this problem, and obtained the following findings:

(1) Deposition of slag from the leading end of the concentrate burner onto the inspection hole frame results in exposure of the castable from outside of the frame due to melting loss of the lowermost portion of the inspection hole frame made of a steel sheet by a high temperature, and slag adhering to this castable grows;

(2) Because of (1) above, it is difficult to peel slag deposit off the inspection hole frame; and furthermore, (3) The slag deposit forms an obstacle, preventing the inspection hole cover from being closed, and causes gas leakage from the gap; and (4) Treatment with a heat-resistant material is necessary for blocking the aforementioned gap.

The inspection hole provided in the reaction shaft ceiling of the flash smelting furnace is used for inspection and cleaning of the burner leading end, and is a very important inspection hole related with burner combustion. Since the inspection frequency is high, it is very important to keep a satisfactory field of vision and to maintain a space sufficient to permit cleaning of the burner.

Japanese patent No. 3381241 discloses installation of a water-cooling jacket around side walls of the reaction shaft and control of coating layers formed on the inner surfaces of the side walls.

The result of research and experiments carried out by the present inventors however reveals that the problem of slag deposition onto the inspection hole frame cannot be solved by the technology of Japanese patent No. 3381241.

The present inventors obtained findings that conversion of the frame of this inspection hole into cooling jackets makes it possible to inhibit growth of slag deposition, easily peel off the slag deposit and facilitate inspection and cleaning of the burner.

The present invention was developed on the basis of such novel findings of the present inventors.

SUMMARY OF THE INVENTION

Accordingly, it is an object of the present invention to provide an inspection hole structure for a flash smelting furnace, which enables to inhibit growth of slag generated near the inspection hole provided in the ceiling of the flash smelting furnace.

It is another object of the present invention to provide an inspection hole structure of a flash smelting furnace, which permits easy peeling of slag which deposits and easy inspection and cleaning of the leading end of a concentrate burner.

It is still another object of the present invention to provide a water-cooling jacket type inspection hole structure for a flash smelting furnace, in which closing of an inspection hole cover is improved and generation of gas leakage is eliminated.

The above-mentioned objects are achieved by an inspection hole structure for a flash smelting furnace of the present invention. In summary, the present invention provides an inspection hole structure for a flash smelting furnace which is installed in the reaction shaft ceiling of the flash smelting furnace, and forms a furnace inspection hole, comprising:

a lower-stage water-cooling jacket having an opening at the center;

an upper-stage water-cooling jacket which is connected integrally to an upper part of said lower-stage water-cooling jacket and forms said inspection hole at the center in cooperation with said lower-stage water-cooling jacket; and a bottom cover water-cooling jacket provided in said lower-stage water-cooling jacket to open or close said opening of said lower-stage water-cooling jacket.

According to an embodiment of the present invention, said lower-stage water-cooling jacket and said upper-stage water-cooling jacket are annular hollow bodies made of a steel sheet, wherein the upper part of said lower-stage water-cooling jacket and a lower part of said upper-stage water-cooling jacket have the same shapes, and connected to each other in the vertical direction, and form an integral cylinder extending from said reaction shaft ceiling upward.

According to another embodiment of the present invention, there is provided an upper cover detachable for opening or closing said upper opening of said inspection hole.

According to the present invention, it is possible:

(1) to inhibit growth of slag generated near the inspection hole provided in the ceiling of the flash smelting furnace;

(2) to easily peel off depositing slag, and easily carry out inspection and cleaning of the leading end of the concentrate burner through the inspection hole; and (3) to improve closing of an inspection hole cover and eliminate occurrence of gas leakage.

DESCRIPTION OF THE PREFERRED EMBODIMENTS

The inspection hole structure for a flash smelting furnace of the present invention will now be described further in detail with reference to the drawings.

Embodiment 1

Figure 1:
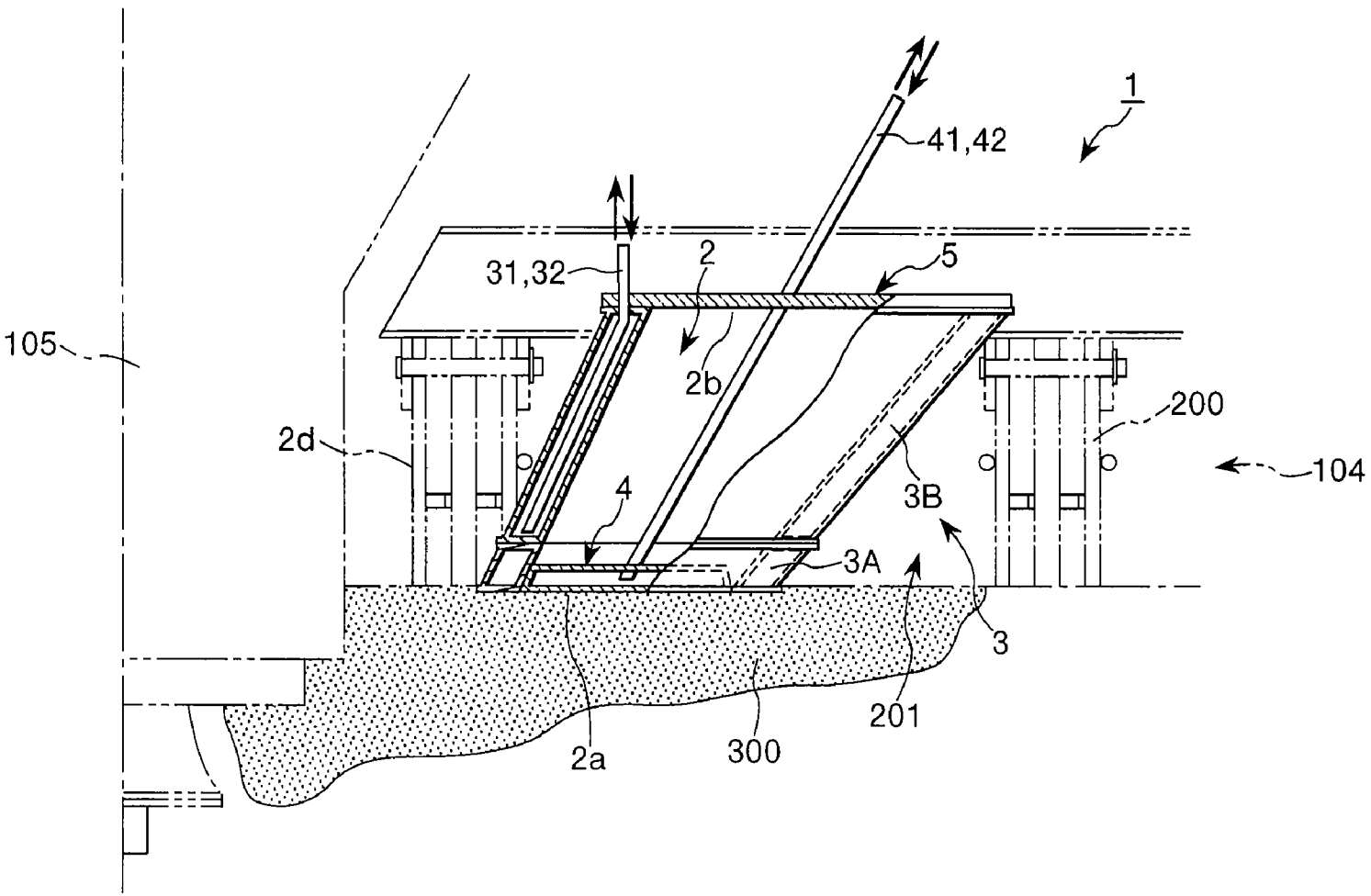
FIG. 1 is a sectional view of the inspection hole structure of the present invention.
Figure 2:
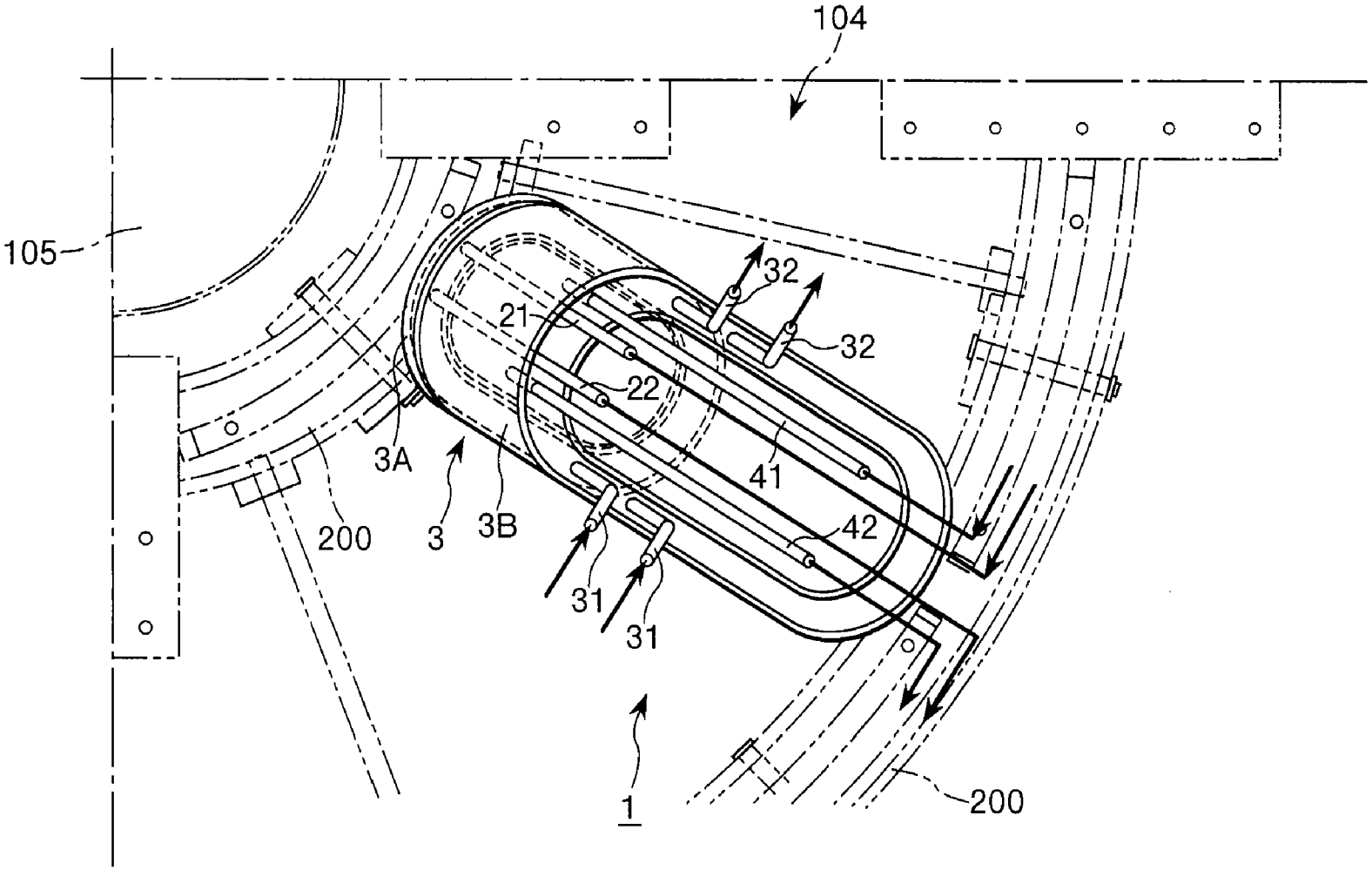
FIG. 2 is a view of the inspection hole structure of the present invention as viewed from above: it shows a state in which the upper cover is removed.
Figure 3:
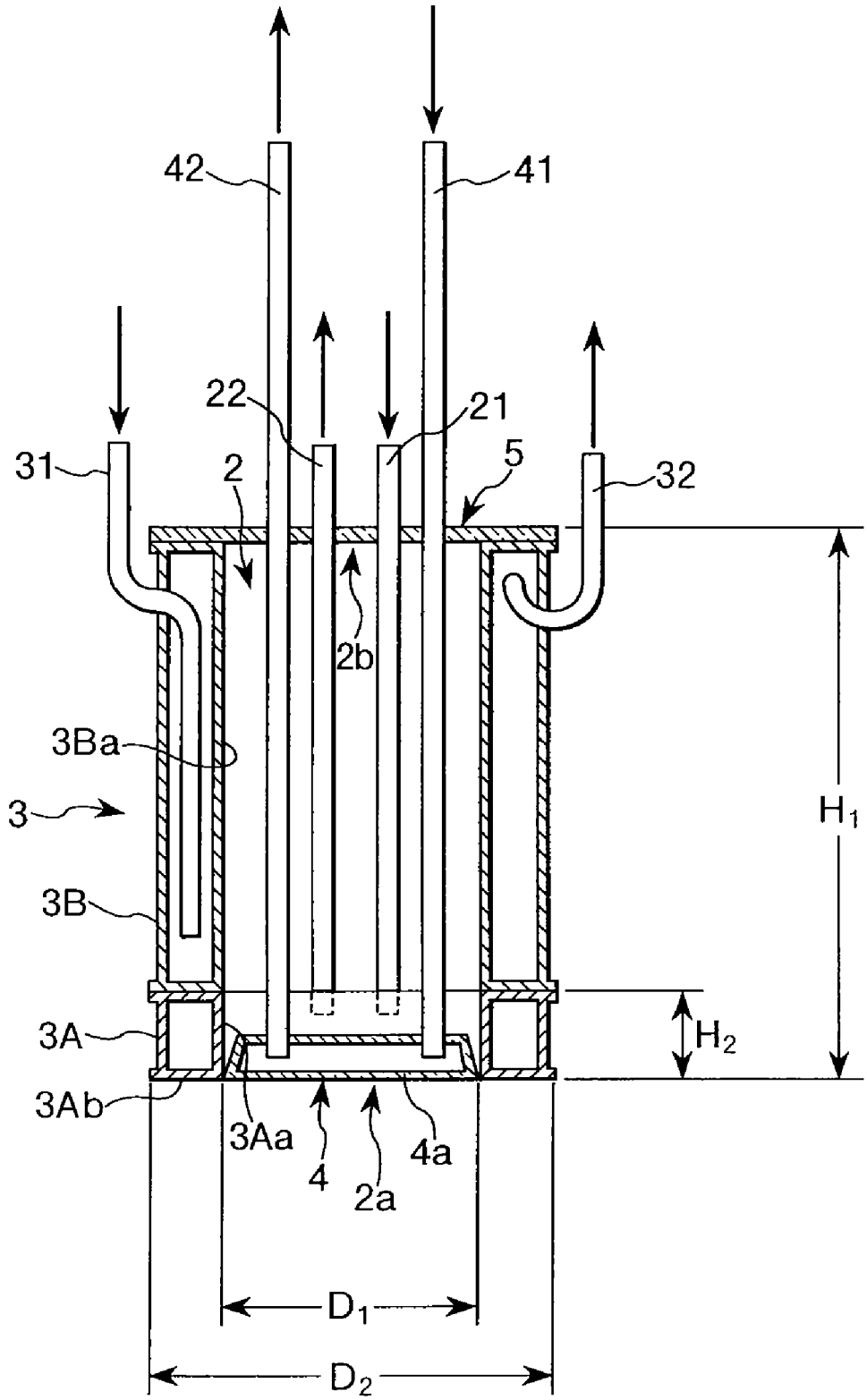
FIG. 3 is a sectional view of the inspection hole structure of the present invention, showing a the flowing state of cooling water.
Figure 4:
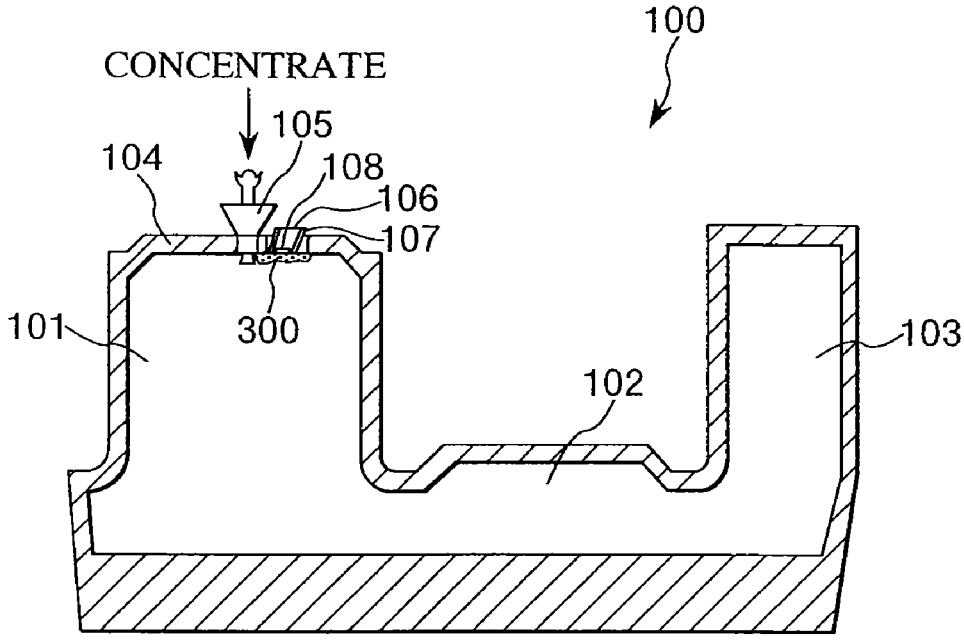
FIG. 4 (Prior Art)
FIG. 4 is a schematic configuration sectional view of a flash smelting furnace.

A schematic configuration of an embodiment of the inspection hole structure for a flash smelting furnace of the present invention is illustrated in FIGS. 1 to 3.

According to this embodiment, an inspection hole structure 1 forming a furnace inspection hole of a flash smelting furnace is provided adjacent to a concentrate burner 105 installed on a ceiling 104 of a reaction shaft.

The inspection hole structure 1 is attached to an attachment opening 201 provided on a ceiling 104 of a reaction shaft formed by an attachment frame 200 or the like. Since the manner of attachment of the inspection hole structure 1 to the ceiling 104 is the same as in the conventional art, the details thereof is not shown.

According to this embodiment, the inspection hole structure 1 has an entire shape comprising a hollow, for example, cylindrical water-cooling jacket 3 (3A, 3B) having a through-opening (i.e., a flash smelting furnace inspection hole) 2 formed at the center thereof. The lower end of the water-cooling jacket is exposed in the furnace, and the upper end thereof projects outside from the ceiling 104.

In other words, the cylindrical water-cooling jacket 3 is formed with the axial line thereof inclined from a lower opening 2*a* of the inspection hole 2 installed in the furnace toward an upper opening 2*b* of the inspection hole 2. From the point of view of operability, in this embodiment, the cylindrical water-cooling jacket 3 is formed so as to have gradually a larger size from a lower opening 2*a* having a bottom cover 4 toward an upper opening 2*b* having an upper cover 5. The shape of the water-cooling jacket is not however limited to that mentioned above, but may be, for example, rectangular. It may have a shape suitable for forming the water-cooling jacket.

In this embodiment, the water-cooling jacket 3 of the inspection hole structure 1 has a two-stage structure comprising a lower-stage water-cooling jacket 3A and an upper-stage water-cooling jacket 3B. A bottom cover water-cooling jacket 4 capable of being opened or closed is installed on an opening 2*a* of the lower-stage water-cooling jacket 3A, and an upper cover 5 serving as closing means is installed so as to be capable of being opened and closed on an upper opening 2*b* of the upper-stage water-cooling jacket 3B.

In other words, as will be understood with reference to FIGS. 1 and 3, the inspection hole structure 1 has the lower-stage water-cooling jacket 3A having an opening 3Aa at the center, installed at the attachment opening 201 of the reaction shaft ceiling 104. The opening 3Aa of the lower-stage water-cooling jacket 3A forms a lower opening 2*a* of the inspection hole 2.

The upper-stage water-cooling jacket 3B having an opening 3Ba forming the inspection hole 2 at the center in cooperation with the opening 3Aa of the lower-stage water-cooling jacket is connected integrally to the upper part of this lower-stage water-cooling jacket 3A. The opening 3Ba of the upper-stage water-cooling jacket 3B forms the upper opening 2*b* of the inspection hole 2.

A bottom cover water-cooling jacket 4 for opening or closing the opening 3Aa of the lower-stage water-cooling jacket 3A, (i.e., the lower opening 2*a* of the inspection hole 2) is installed detachably, i.e., so as to be capable of being opened or closed relative to the opening 2*a* on the inside of the lower-stage water-cooling jacket 3A. An upper cover 5 for opening and closing the aforementioned opening 2*b* is arranged at an upper part of the upper opening (i.e., upper opening 2*b* of the inspection hole 2) of the opening 3Ba of the upper-stage water-cooling jacket 3B.

More specifically, the lower-stage water-cooling jacket 3A and the upper-stage water-cooling jacket 3B are formed, with steel sheets, into annular hollow bodies having, for example, a rectangular cross-section. The upper portion of the lower-stage water-cooling jacket 3A and the lower portion of the upper-stage water-cooling jacket 3B have the same shapes and are connected into an integral configuration mutually connected in the vertical direction. In other words, the lower-stage water-cooling jacket 3A and the upper-stage water-cooling jacket 3B form an integral cylindrical shape having an axial line extending upward from the ceiling frame side. In this embodiment, however, the upper-stage water-cooling jacket 3B is larger in size in the axial direction than the lower-stage water-cooling jacket 3A which in this embodiment accounts for about 80 to 85% of the axial-direction length of the entire inspection hole 2.

An example of concrete size is as follows. In FIG. 3, the inspection hole structure 1 in the case where it has a cylindrical water-cooling jacket has an inside diameter D1 of 25 to 39 cm, an outside diameter D2 of 40 to 57 cm, and a vertical height H1 of 53 cm, and a height H2 of the lower-stage water-cooling jacket 3A of 7 to 10 cm. It is needless to mention that the size is not limited to these values.

As will be understood from the above, the lower-stage water-cooling jacket 3A is in an area positioned along the outer periphery of the bottom cover water-cooling jacket 4. In other words, the main purpose of the lower-stage water-cooling jacket 3A is to cool the area where the inspection hole structure 1 is positioned in the flash smelting furnace and thus to inhibit growth of slag generated on the furnace side. This means that the lower closing means of the inspection hole 2, i.e., the bottom cover 4 serving as a water-cooling jacket is for preventing slag produced on the furnace side from making it impossible to open or close the cover. In the present invention, the bottom cover 4 also has a water-cooling jacket structure, leading to considerable inhibition of growth of slag generated on the furnace side. The bottom cover water-cooling jacket 4 has a hollow shape so as to permit circulation of cooling water in the interior.

As shown in FIGS. 2 and 3 in the best way, a cooling water inlet duct 41 and an outlet duct 42 are installed on the bottom cover water-cooling jacket 4 through an upper cover 5. A cooling water inlet duct 21 and an outlet duct 22 are connected to the lower-stage water-cooling jacket 3A, and a cooling water inlet duct 31 and an outlet duct 32 are connected to the upper-stage water-cooling jacket 3B.

The connecting manner of the cooling water inlet ducts 21, 31 and 41 and the outlet ducts 22, 32 and 42 to the individual water-cooling jackets 3A, 3B and 4 is not limited to that mentioned above, but various manners are appropriately adoptable. In this embodiment, however, the flow rate of cooling water is controlled so that the cooling water exit temperature of the lower-stage water-cooling jacket 3A, the upper-stage water-cooling jacket 3B and the bottom-cover water-cooling jacket 4 may be 40 to 55° C. A typical example is as follows:

Lower-Stage Water-Cooling Jacket 3A:
Inlet cooling water temperature: 35 to 40° C.
Outlet cooling water temperature: 45 to 50° C.

Upper-Stage Water-Cooling Jacket 3B:
Inlet cooling water temperature: 35 to 40° C.
Outlet cooling water temperature: 40 to 45° C.

Bottom Cover Water-Cooling Jacket 4:
Inlet cooling water temperature: 35 to 40° C.
Outlet cooling water temperature: 45 to 50° C.

A conventional problem was that the inspection frame of the lowermost part of the inspection hole was melting-damaged by a high temperature, causing the castable on the furnace side of the inspection hole frame to be exposed, thus accelerating deposition and growth of slag. In the case of the inspection hole structure 1 of the present invention having the aforementioned configuration, it is possible to considerably inhibit deposition and growth of slag by converting the conventional inspection hole frame into water-cooling jackets, i.e., by adopting a configuration comprising a lower-stage water-cooling jacket 3A and an upper-stage water-cooling jacket 3B.

The bottom cover itself is converted into a water-cooling jacket. This, together with the water cooling effect of the lower-stage and an upper-stage water-cooling jackets 3A and 3B, prevents deposition and growth of slag, and eliminates occurrence of impossibility trouble of opening/closing operation of the bottom cover 4. As a result, gas leakage from the furnace side caused by impossibility to close the bottom cover is eliminated.

In a flash smelting furnace having the inspection hole structure 1 of the present invention, the bottom cover water-cooling jacket 3A is free from deposition of slag, thus enabling to easily remove the bottom cover water-cooling jacket 4 upwardly from the inspection hole 2. Therefore, by pulling out and removing out upwardly the upper cover 5 and the bottom cover water-cooling jacket 4 from the inspection hole 2, it is possible to clean the burner 105, and as required, easily peel off slag 300 adhering near the concentrate burner via the inspection hole 2.

The conventional inspection hole frame is modified into water-cooling jackets in a two-jacket configuration including a lower-stage water-cooling jacket 3A and an upper-stage water-cooling jacket 3B. Even when water leakage is caused in the lower water-cooling jacket 3A, therefore, it is possible to ensure protection by the upper water-cooling jacket 3B, thus extending the service life of the inspection hole structure 1.

What is claimed is:

1. An inspection hole structure for a flash smelting furnace which is installed in a reaction shaft ceiling of the flash smelting furnace, and forms a furnace inspection hole, comprising:

a lower-stage water-cooling jacket in a form of a single chamber having an opening at the center;

an upper-stage water-cooling jacket in a form of a single chamber, which is connected integrally to an upper part of said lower-stage water-cooling jacket and forms said inspection hole at the center in cooperation with said lower-stage water-cooling jacket; and a bottom cover water-cooling jacket provided in said lower-stage water-cooling jacket to open or close said opening of said lower-stage water-cooling jacket, wherein the lower-stage water-cooling jacket and the upper-stage water-cooling jacket are not fluidly connected; and wherein the lower-stage water-cooling jacket and the upper-stage water-cooling jacket are serially positioned along a longitudinal direction of the inspection hole.

2. The inspection hole structure for a flash smelting furnace, according to claim 1, wherein said lower-stage water-cooling jacket and said upper-stage water-cooling jacket are annular hollow bodies made of steel sheets, and wherein an upper part of said lower-stage water-cooling jacket and a lower part of said upper-stage water-cooling jacket have the same shapes, are connected to each other in a vertical direction, and form an integral cylinder extending from said reaction shaft ceiling upward.

3. The inspection hole structure for a flash smelting furnace, according to claim 1, wherein there is provided an upper cover detachable for opening or closing said upper opening of said inspection hole.

4. The inspection hole structure for a flash smelting furnace, according to claim 2, wherein there is provided an upper cover detachable for opening or closing said upper opening of said inspection hole.

* * * * *